US009253585B2

(12) United States Patent
Kuroki et al.

(10) Patent No.: US 9,253,585 B2
(45) Date of Patent: Feb. 2, 2016

(54) SPEAKER APPARATUS

(75) Inventors: Ryuichiro Kuroki, Hamamatsu (JP); Masakazu Kato, Hamamatsu (JP); Julian Ward, Birmingham (GB)

(73) Assignee: Yamaha Corporation, Hamamatsu-shi (JP)

( * ) Notice: Subject to any disclaimer, the term of this patent is extended or adjusted under 35 U.S.C. 154(b) by 358 days.

(21) Appl. No.: 13/599,123

(22) Filed: Aug. 30, 2012

(65) Prior Publication Data

US 2013/0051563 A1 Feb. 28, 2013

(30) Foreign Application Priority Data

Aug. 31, 2011 (JP) ..... 2011-189285

(51) Int. Cl.

| | |
|---|---|
| ***H04R 5/00*** | (2006.01) |
| ***H04S 7/00*** | (2006.01) |
| *H04R 5/02* | (2006.01) |
| *H04R 1/46* | (2006.01) |
| *H04S 1/00* | (2006.01) |
| *H04S 5/00* | (2006.01) |

(52) U.S. Cl.

CPC ... *H04S 7/30* (2013.01); *H04R 1/46* (2013.01); *H04S 1/007* (2013.01); *H04S 5/00* (2013.01); *H04S 2400/15* (2013.01)

(58) Field of Classification Search

CPC ..... H04S 1/002; H04S 3/002; H04S 5/00; H04S 7/302; H04S 2400/01; H04S 2400/15; H04S 3/00; H04S 7/30; H04S 1/46; H04S 2420/03

USPC ..... 381/17, 306

See application file for complete search history.

(56) References Cited

U.S. PATENT DOCUMENTS 4,706,287 A 11/1987 Blackmer et al.
5,046,097 A 9/1991 Lowe et al.

(Continued)

FOREIGN PATENT DOCUMENTS

CN 1050119 A 3/1991
JP 6-121394 A 4/1994

(Continued)

OTHER PUBLICATIONS

Extended European Search Report dated Dec. 21, 2012 (seven (7) pages).

(Continued)

*Primary Examiner* — Paul S Kim
*Assistant Examiner* — Norman Yu
(74) *Attorney, Agent, or Firm* — Crowell & Moring LLP

(57) ABSTRACT

A speaker apparatus includes speaker units, a first inputting section to which one channel audio signal is supplied, a second inputting section to which at least L-channel and R-channel audio signals are supplied, an acoustic effect imparting section that performs a first signal processing on the audio signal supplied to the first inputting section to output L channel and R channel audio signals, an outputting section that outputs the audio signal supplied to the first inputting section to at least one of the speaker units, and a widening effect imparting section that performs a second signal processing for imparting a sound image widening effect on both the L-channel and R-channel audio signals and the at least L-channel and R-channel audio signals and supplies processed audio signals to speaker units for corresponding channels respectively.

7 Claims, 8 Drawing Sheets

(56) References Cited

U.S. PATENT DOCUMENTS

| | | | | |
|---|---|---|---|---|
| 5,105,462 | A | 4/1992 | Lowe et al. | |
| 5,208,860 | A | 5/1993 | Lowe et al. | |
| 5,305,386 | A * | 4/1994 | Yamato | 381/1 |
| 5,369,224 | A | 11/1994 | Miyata | |
| 5,732,142 | A | 3/1998 | Nagata et al. | |
| 5,974,153 | A | 10/1999 | Cashion et al. | |
| 6,067,360 | A | 5/2000 | Kasai et al. | |
| 6,111,958 | A | 8/2000 | Maher | |
| 6,198,826 | B1 | 3/2001 | Cowieson et al. | |
| 6,236,730 | B1 * | 5/2001 | Cowieson et al. | 381/18 |
| 7,003,119 | B1 | 2/2006 | Arthur | |
| 2004/0175001 | A1 | 9/2004 | Sakagami et al. | |
| 2007/0286426 | A1 | 12/2007 | Xiang et al. | |
| 2009/0060210 | A1 | 3/2009 | Sakagami et al. | |
| 2009/0304186 | A1 | 12/2009 | Katayama et al. | |

FOREIGN PATENT DOCUMENTS

| | | | |
|---|---|---|---|
| JP | 7-319487 | A | 12/1995 |
| JP | 7-334182 | A | 12/1995 |
| JP | 8-23595 | A | 1/1996 |
| JP | 9-114479 | A | 5/1997 |
| JP | 10-28097 | A | 1/1998 |
| JP | 10-336800 | A | 12/1998 |
| JP | 11-150799 | A | 6/1999 |
| JP | 2004-266604 | A | 9/2004 |
| JP | 2009-540686 | A | 11/2009 |
| JP | 2009-302666 | A | 12/2009 |
| JP | 2010-034755 | A | 2/2010 |
| WO | WO 00/59265 | A1 | 10/2000 |

OTHER PUBLICATIONS

European Office Action dated Jul. 16, 2013 {Five (5) pages}.

Chinese Office Action dated May 27, 2014 with English Translation (fifteen (15) pages).

Japanese Office Action dated Mar. 17, 2015, with English translation (Eleven (11) pages).

* cited by examiner

SPEAKER APPARATUS

BACKGROUND

The present invention relates to a technique for controlling sound image localization.

In a sound emitting apparatus which can emit a sound in stereo, in the case where the gap between two speaker units is narrow, the apparent angle of the positions of the speaker units as viewed from the listener is small, and the impression of widening the sound field is not largely felt. This is caused because, in the case where two speaker units are used, the range where the sound field is localizable is limited between the two speaker units. Therefore, a technique has been developed in which the range where the sound image is localizable is widened to the outside of the space between speakers, by applying signal processing to audio signals that are to be supplied to the respective speakers. As such a technique for widening the sound image localization range, various techniques such as a technique in which crosstalk cancelling is used, and that in which an HRTF (Head-Related Transfer Function) is used have been disclosed (for example, JP-A-7-334182, JP-A-2009-302666, JP-A-10-28097 and JP-A-9-114479).

In a small amplifier for a musical instrument (hereinafter, such an amplifier is referred to as a musical instrument amplifier), for example, it is often that a sound emitted from a sounding body, such as an instrument sound is input in the form of a monaural audio signal, and then output from one speaker unit. Also an amplifier for a musical instrument is known in which a plurality of speakers are disposed, and also a music piece or the like can be emitted together with an instrument sound. In such a small musical instrument amplifier, however, the gap between speakers is narrow, and hence the stereo impression of the music piece cannot be sufficiently obtained. Also in the case where an acoustic effect of a spatial system is imparted to an instrument sound, moreover, a sufficient stereo impression is not similarly obtained, localization of the sound image becomes unclear, and the localization sensation is lost. Therefore, the listener cannot sometimes clearly listen to the sound of the musical instrument.

When the technique disclosed in JP-A-7-334182 is used in a musical instrument amplifier which can emit a sound of a music piece or the like together with an instrument sound, the direct sound is clear, and hence the instrument sound is clearly listened to a listener. By contrast, also the sound of the music piece which is emitted together with the instrument sound is listened to the listener as the direct sound. Therefore, when the listener wishes to, while playing a musical instrument, listen to a sound of a music piece in the background, for example, there is a case where, although the listener wants to listen to the instrument sound more clearly than the sound of the music piece, also the sound of the music piece can be clearly listened to, and therefore the sound of the music piece may disturb listening of the instrument sound.

SUMMARY

It is an object of the present disclosure to, in the case where a speaker apparatus using a technique for widening the sound image localization range emits a sound from a sounding body, and a sound in which an acoustic effect of a spatial system is imparted to the sound from the sounding body, together with a sound of a music piece or the like, widen the stereo impressions of the music piece and the sound to which the acoustic effect is imparted, and enable the sound from the sounding body to be clearly listened to without impairing the sound quality and the localization sensation.

In order to solve the problems, the present disclosure provides a speaker apparatus including:

a sound emitting section that includes a plurality of speaker units, each of which converting a supplied audio signal to a sound and outputting the sound, and the speaker units including a speaker unit for an L channel and a speaker unit for an R channel;

a first inputting section to which one channel audio signal indicating a sound from a sounding body is supplied;

a second inputting section to which at least L-channel and R-channel audio signals are supplied;

an acoustic effect imparting section that performs a first signal processing for imparting an acoustic image of stereo effect, on the audio signal supplied to the first inputting section to output L channel and R channel audio signals;

an outputting section that outputs the audio signal supplied to the first inputting section, to at least one of the speaker units; and a widening effect imparting section that performs a second signal processing for imparting a sound image widening effect which widens a range where a sound image is localizable, to be larger than a gap between the speaker unit for the L channel and the speaker unit for the R channel, on both the L-channel and R-channel audio signals output from the acoustic effect imparting section and the at least L-channel and R-channel audio signals supplied to the second inputting section, to supply processed audio signals to speaker units for corresponding channels respectively, among the speaker units.

For example, the outputting section performs a third signal processing which is different from the first signal processing in the acoustic effect imparting section, on the audio signal supplied to the first inputting section, to output a processed audio signal to the at least one of the speaker units.

For example, the outputting section splits the audio signal supplied to the first inputting section into two audio signals to output the two audio signals to the at least one of the speaker units.

For example, the audio signal output from the outputting section is supplied to the at least one of the speaker units to which the widening effect imparting section supplies the processed audio signals.

For example, the speaker units of the sound emitting section include a middle speaker unit which is disposed between the speaker unit for the L channel and the speaker unit for the R channel, and the audio signal output from the outputting section is supplied to the middle speaker unit.

For example, the widening effect imparting section combines the L-channel and R-channel audio signals output from the acoustic effect imparting section with the at least L-channel and R-channel audio signals supplied to the second inputting section for each channel, and performs the second signal processing for imparting the sound image widening effect on the combined audio signals.

For example, the widening effect imparting section performs different signal processings on the L-channel and R-channel audio signals output from the acoustic effect imparting section and the at least L-channel and R-channel audio signals supplied to the second inputting section, respectively, so as to set different ranges where the sound images are localizable.

According to the present disclosure, in the case where a speaker apparatus using a technique for widening the sound image localization range emits a sound from a sounding body, and a sound in which an acoustic effect of a spatial system is imparted to the sound from the sounding body, together with a sound of a music piece or the like, the stereo impressions of the music piece and the sound to which the acoustic effect is imparted can be widened, and the sound from the sounding body can be clearly listened to without impairing the sound quality and the localization sensation.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

Embodiment

Appearance of Speaker Apparatus 1

Figure 1:
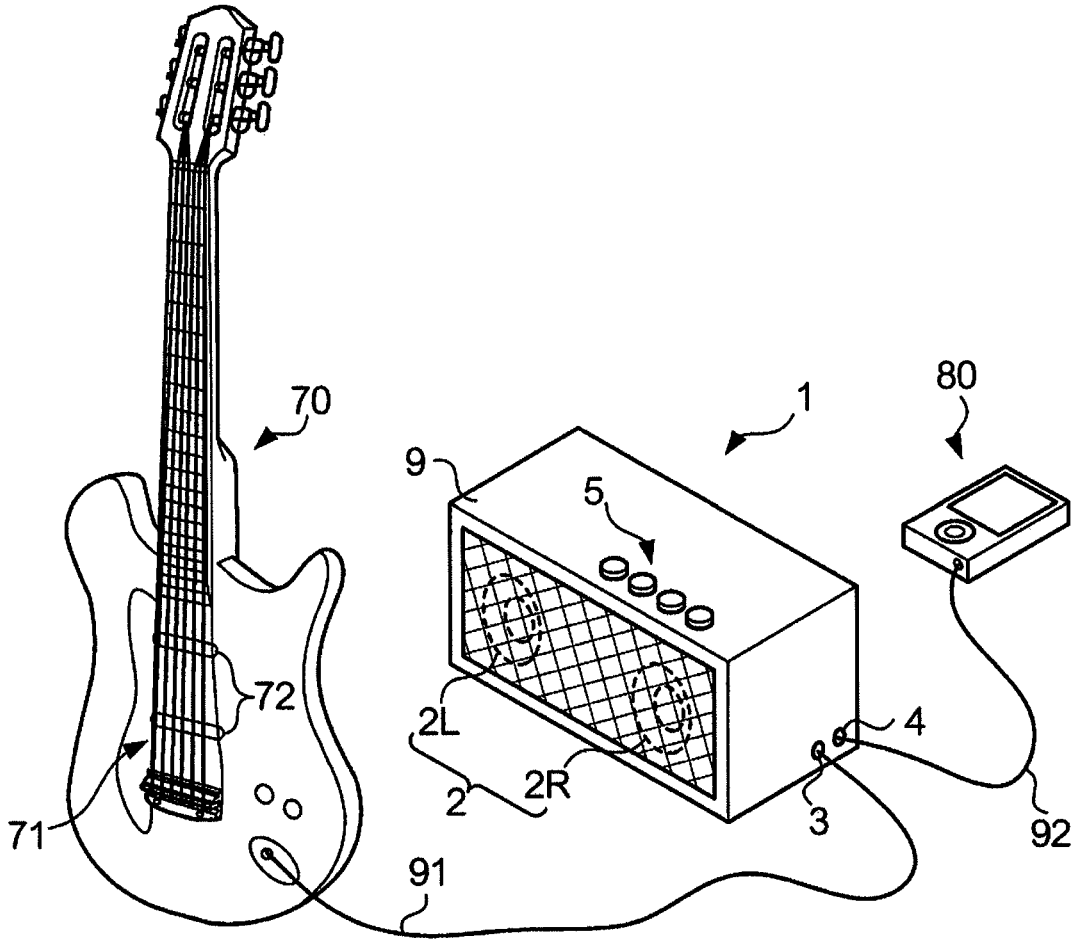
FIG. 1 is a view illustrating the appearance of a speaker apparatus according to an embodiment of the present disclosure.

FIG. 1 is a view illustrating the appearance of a speaker apparatus 1 according to an embodiment of the present disclosure. The speaker apparatus 1 is a musical instrument amplifier and includes a speaker section 2 configured by an L-channel speaker unit 2L and an R-channel speaker unit 2R, a monaural input terminal 3, a stereo input terminal 4, and an operating section 5. These elements are disposed in a case 9 having a substantially rectangular parallelepiped shape. In the elements described below, those denoted by a reference numeral with "L" affixed thereto correspond to the L channel, and those denoted by a reference numeral with "R" affixed thereto correspond to the R channel. Elements denoted by a reference numeral with "M" affixed thereto correspond to monaural.

The speaker units 2L, 2R are disposed so as to emit a sound in the normal direction of one surface of the case 9 (hereinafter, the normal direction is referred to as the front direction of the speaker apparatus 1). The speaker units 2L, 2R are attached to the case 9 so that, when the speaker apparatus 1 is viewed from the listener located in the front direction of the speaker apparatus 1, the speaker unit 2L is positioned in the left side, and the speaker unit 2R is positioned in the right side.

The monaural input terminal 3 and the stereo input terminal 4 are terminals that have shapes into which plugs disposed in end portions of cables 91, 92 for transmitting audio signals are insertable, respectively. Analog audio signals are input to the terminals. The input terminals may be terminals to which connectors through which digital signals are input and output, such as USB (Universal Serial Bus) terminals are connected, so that digital audio signals can be input.

A monaural (one-channel) audio signal indicating an instrument sound or the like is supplied to the monaural input terminal 3. In this example, an audio signal indicating contents of sound emission due to playing of a guitar 70 is supplied to the monaural input terminal 3 through the cable 91. The audio signal is generated as a result that vibrations (contents of sound emission) of strings 71 due to playing of the guitar 70 are detected by pickups 72.

Here, sound emission due to playing of the guitar 70 is exemplified as an instrument sound. Alternatively, another musical instrument may be used. Namely, a configuration is requested where contents of sound emission due to playing of a musical instrument are detected by a sound detecting device such as a pickup or a microphone, and an audio signal according to the contents of sound emission is supplied to the monaural input terminal 3. The sound emission is not limited to playing of a musical instrument, and may be caused by singing or the like. In this way, it is requested that a monaural audio signal obtained by detecting vibrations caused by sound emission from a sounding body is supplied to the monaural input terminal 3.

Stereo (two-channel) audio signals indicating a music piece or the like are supplied to the stereo input terminal 4. In this example, audio signals indicating a sound of a music piece which is produced in an audio player 80 are supplied to the stereo input terminal 4 through the cable 92. The audio player 80 stores audio data indicating a sound of a music piece, and, in accordance with instructions input by the listener, produces and outputs audio signals indicating the sound of the music piece. Here, the audio player 80 has been exemplarily described. However, any apparatus may be used as far as it can produce and output stereo audio signals.

The operating section 5 is an operating device which is used for setting parameters for controlling a sound emitted from the speaker section 2. For example, parameters which can be set in the operating section 5 are the volume level, parameters (levels in high, intermediate, and low frequency ranges) which are to be used in an equalizer, parameters (the size of the sound image localization range, the kind of the acoustic effect, the degree of the impartation, etc.) which are to be used in signal processing that will be described later, the combination ratios of audio signals, and the like.

The appearance of the speaker apparatus 1 has been described. Then, the effect of widening the sound image localization range will be described with reference to FIG. 2.

Figure 2:
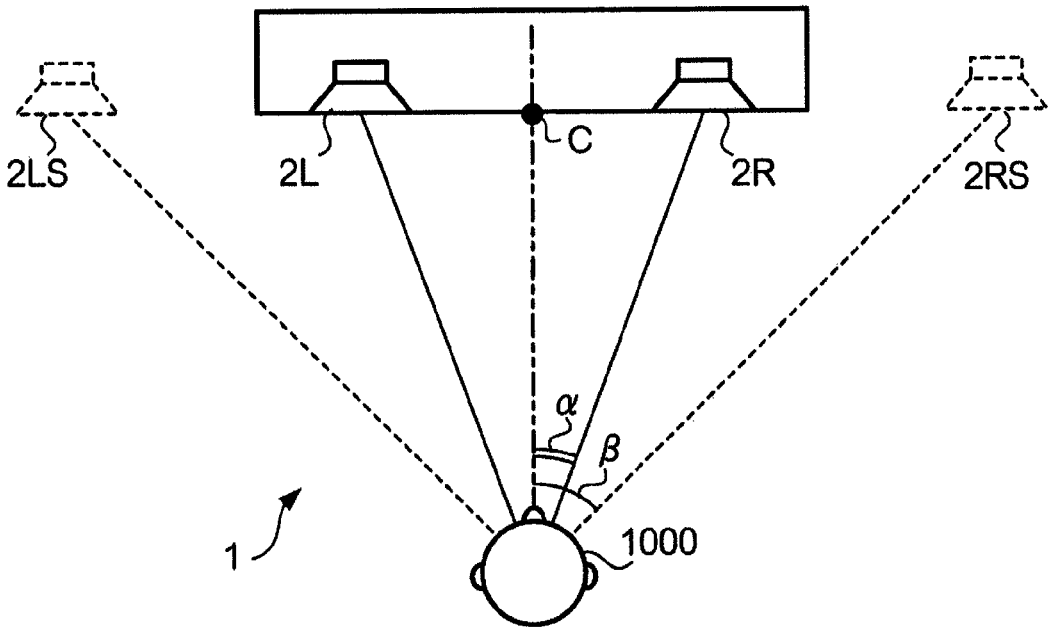
FIG. 2 is a diagram illustrating an effect of widening a sound image localization range which is realized by the speaker apparatus according to the embodiment of the present disclosure.

FIG. 2 is a diagram illustrating the effect of widening the sound image localization range which is realized by the speaker apparatus 1 according to the embodiment of the present disclosure. In FIG. 2, the positional relationship between the listener 1000 and the speaker apparatus 1 is shown in the form of a diagram as viewed from the upper side (in FIG. 1, on the side of the surface where the operating section 5 is disposed) of the speaker apparatus 1. It is assumed that the listener 1000 listens to a sound on the front side of the speaker apparatus 1 with respect to the midpoint C between the speaker units 2L, 2R.

The effect of widening the sound image localization range (hereinafter, the effect is referred to as the sound image widening effect) means an effect in which the positions (the apparent angle is $2\alpha$) of the speaker units 2L, 2R that are sensed by the listener 1000 are widened to those (the apparent angle is $2\beta$ ($\alpha<\beta$)) of virtual speakers 2LS, 2RS, thereby widening the range where the sound image is localizable from between the speaker units 2L, 2R to between the virtual speakers 2LS, 2RS.

This phenomenon occurs because, when sounds to which the sound image widening effect is imparted as described later are emitted from the speaker units 2L, 2R to reach the ears of the listener 1000, the listener 1000 is caused to sense as if the sounds are emitted from the positions of the virtual speakers 2LS, 2RS, due to the frequency characteristics, and influences such as that crosstalk is cancelled.

Then, the configuration of the speaker apparatus 1 will be described.

[Configuration of Speaker Apparatus 1]

Figure 3:
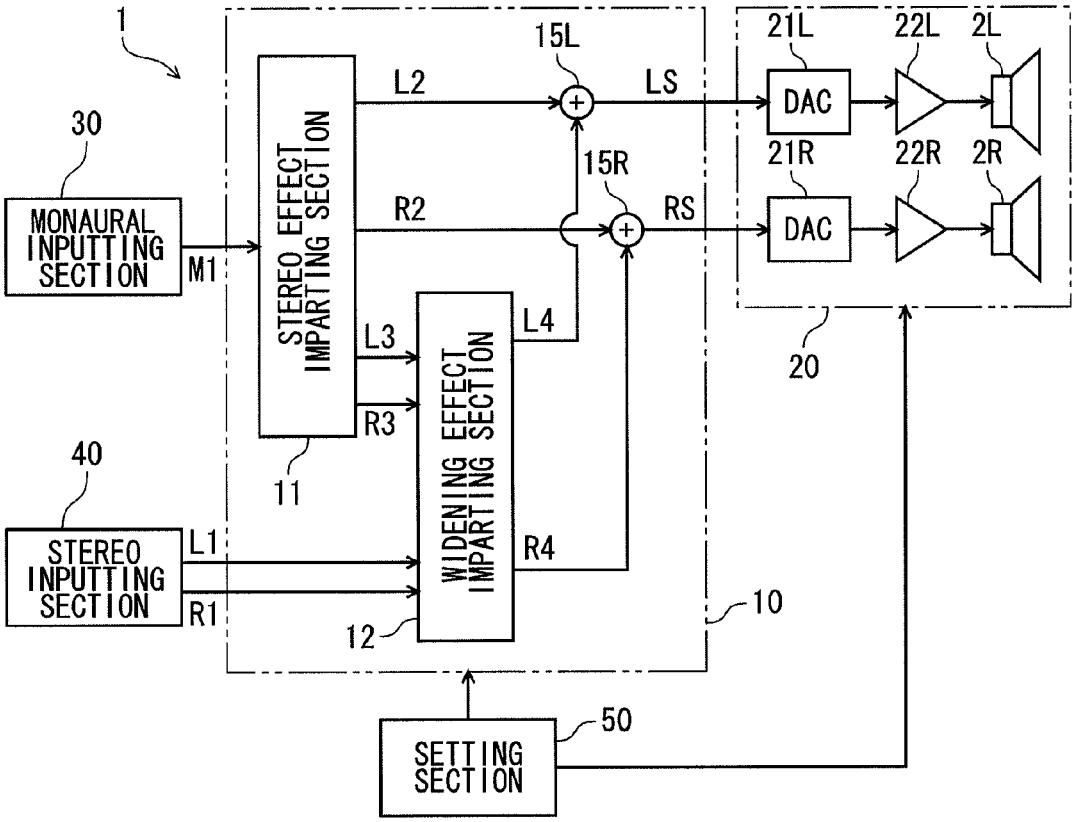
FIG. 3 is a block diagram illustrating the configuration of the speaker apparatus according to the embodiment of the present disclosure.

FIG. 3 is a block diagram illustrating the configuration of the speaker apparatus 1 according to the embodiment of the present disclosure. The speaker apparatus 1 includes a signal processing section 10, a sound emitting section 20, a monaural inputting section 30, a stereo inputting section 40, and a setting section 50.

The monaural inputting section 30 has an AD (Analog/Digital) converting section which converts a monaural audio signal input through the monaural input terminal 3, from an analog signal to a digital signal, and supplies an audio signal M1 which is converted into a digital signal, to a stereo effect imparting section 11 of the signal processing section 10.

The stereo inputting section 40 has an AD converting section which converts stereo audio signals input through the stereo input terminal 4 from analog signals to digital signals, and supplies audio signals L1, R1 which are converted into digital signals, to a widening effect imparting section 12 of the signal processing section 10.

In the case where audio signals which are to be input through the above-described input terminals are digital signals, the AD converting sections are not necessary.

The signal processing section 10 has the stereo effect imparting section 11, the widening effect imparting section 12, and combining sections 15L, 15R. The configuration of the stereo effect imparting section 11 will be described with reference to FIG. 4, and that of the widening effect imparting section 12 will be described with reference to FIG. 5.

Figure 4:
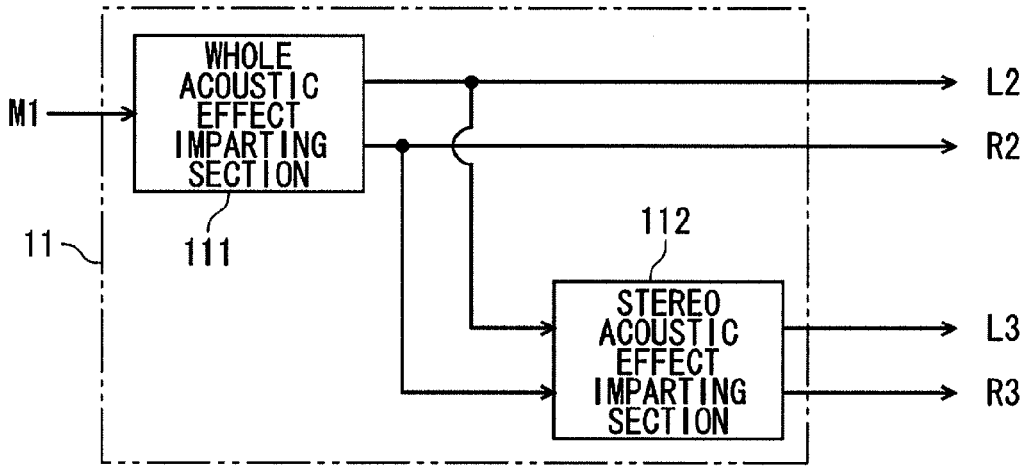
FIG. 4 is a block diagram illustrating the configuration of a stereo effect imparting section in the embodiment of the present disclosure.

FIG. 4 is a block diagram illustrating the configuration of the stereo effect imparting section 11 in the embodiment of the present disclosure. The stereo effect imparting section 11 has a whole acoustic effect imparting section (outputting section) 111 and a stereo acoustic effect imparting section (acoustic effect imparting section) 112.

The whole acoustic effect imparting section 111 performs signal processing in which the input audio signal M1 is divided into an L-channel audio signal L2 and an R-channel audio signal R2, and a predetermined acoustic effect is imparted. The audio signals L2, R2 are supplied to the combining sections 15L, 15R, and the stereo acoustic effect imparting section 112.

The signal processing may be imparted to the audio signal M1, or to the audio signals L2, R2. Alternatively, signal processing in which different acoustic effects are imparted to the audio signal M1 and the audio signals L2, R2, respectively may be performed. In the case where signal processing is performed only on the audio signal M1, the audio signals L2, R2 are identical to each other.

The acoustic effect to be imparted in the whole acoustic effect imparting section 111 is requested to be different from that which is imparted in the stereo acoustic effect imparting section 112. For example, it is preferable that the acoustic effect is an acoustic effect such as an acoustic effect (compressor, distortion, etc.) which is called the dynamic system effect, or that (equalizer, etc.) which is called the filter system effect. Alternatively, the acoustic effect may be an acoustic effect (reverb, delay, etc.) which is called the spatial system effect that is often used as a stereo effect, or that (chorus, flanger, etc.) which is called the modulation system effect. However, it is preferable that the acoustic effect is different from an acoustic image of stereo effect which will be described later.

The whole acoustic effect imparting section 111 may perform only the division of the input audio signal M1 into the L-channel audio signal L2 and the R-channel audio signal R2, and may not perform the signal processing for imparting an acoustic effect. In the case where the signal processing for imparting an acoustic effect is not performed, the audio signals L2, R2 are identical with the audio signal M1.

The stereo acoustic effect imparting section 112 performs signal processing in which the acoustic image of stereo effect is imparted to the input audio signals L2, R2, and outputs the processed signals. The audio signals output from the stereo acoustic effect imparting section 112 are referred to as audio signals L3, R3.

The stereo effect in the example means an acoustic effect in which, for example, the delay effect in which L and R channels are differently delayed is applied as often used as the spatial system effect, thereby causing spatial widening to be felt. In the signal processing for imparting the acoustic image of stereo effect, namely, the signal processing which is performed on the audio signal L2, and that which is performed on the audio signal R2 are different from each other, and, even when the audio signals L2, R2 are identical with each other, the audio signals L3, R3 are therefore different from each other.

On the other hand, the acoustic effect which is imparted in the above-described whole acoustic effect imparting section 111 may be the stereo effect, but preferably may not the stereo effect.

Figure 5:
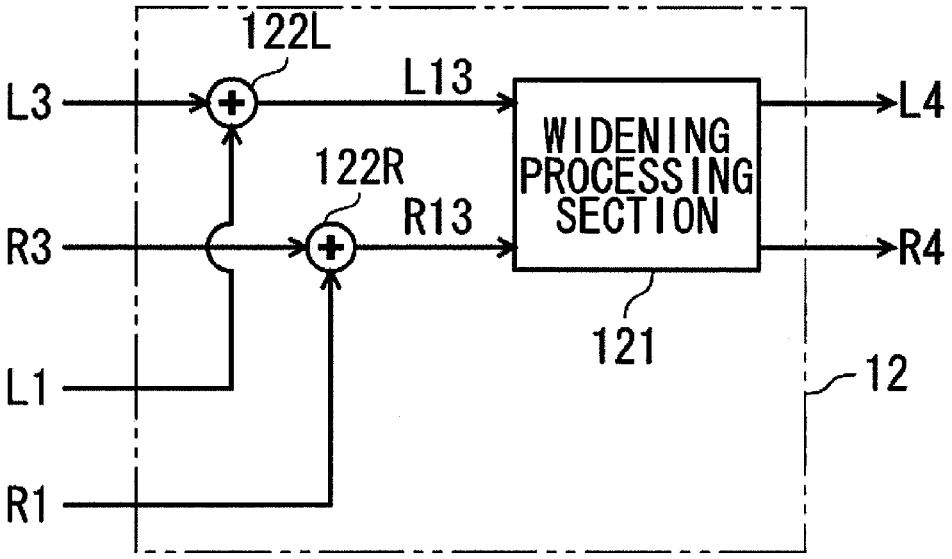
FIG. 5 is a block diagram illustrating the configuration of a widening effect imparting section in the embodiment of the present disclosure.

FIG. 5 is a block diagram illustrating the configuration of the widening effect imparting section 12 in the embodiment of the present disclosure. The widening effect imparting section 12 has a widening processing section 121, and combining sections 122L, 122R.

The combining section 122L combines the audio signals L3, L1 with each other by addition, and outputs the combined signal. The audio signal which is output from the combining section 122L is referred to as an audio signal L13. The combining section 122R combines the audio signals R3, R1 with each other by addition, and outputs the combined signal. The audio signal which is output from the combining section 122R is referred to as an audio signal R13. The audio signals L13, R13 are supplied to the widening processing section 121.

The widening processing section 121 performs signal processing for imparting the above-described sound image widening effect to the input audio signals L13, R13, and outputs the resulting signals. The audio signals which are output from the widening processing section 121 are referred to as audio signals L4, R4, respectively.

As the signal processing for imparting the sound image widening effect, various known techniques such as a technique in which crosstalk cancelling is used, and that in which an HRTF is used can be applied. The signal processing for imparting the sound image widening effect is realized by using a delay circuit, an FIR (Finite Impulse Response) filter, and the like. The principle of obtaining the sound image widening effect by these techniques, and contents of specific signal processing are described in, for example, the above-described references JP-A-7-334182, JP-A-2009-302666, JP-A-10-28097 and JP-A-9-114479.

Returning to FIG. 3, the description will be continued. The combining section 15L combines the audio signals L2, L4 with each other by addition and outputs the combined signal. The audio signal which is output from the combining section 15L is referred to as an audio signal LS. The combining section 15R combines the audio signals R2, R4 with each other by addition, and outputs the combined signal. The audio signal which is output from the combining section 15R is referred to as an audio signal RS.

The sound emitting section 20 has DA (Digital/Analog) converting sections (DACs) 21L, 21R, amplifying sections 22L, 22R, and the speaker units 2L, 2R. The speaker units 2L, 2R convert the supplied audio signals into sounds, and output (emit) the sounds.

The DA converting section 21L converts the supplied audio signal LS from a digital signal to an analog signal, and outputs the analog audio signal. The amplifying section 22L amplifies the audio signal LS which has been converted into an analog signal, and supplies the amplified signal to the speaker unit 2L, thereby causing a sound to be emitted. The DA converting section 21R converts the supplied audio signal RS from a digital signal to an analog signal, and outputs the analog audio signal. The amplifying section 22R amplifies the audio signal RS which has been converted into an analog signal, and supplies the amplified signal to the speaker unit 2R, thereby causing a sound to be emitted.

The sound emitting section 20 may have an equalizer, and change the frequency characteristics of the audio signals LS, RS.

The setting section 50 sets various parameters in the signal processing section 10 and the sound emitting section 20 in accordance with the positions (in the case of a volume knob, the rotational position or the like) of operating elements of the operating section 5. In the example, the setting section 50 sets the kinds of the acoustic effects imparted in the whole acoustic effect imparting section 111 and the stereo acoustic effect imparting section 112, the degrees of the impartations, the degree (the width of the sound image localization range or the like) of the impartation of the sound image widening effect in the widening processing section 121, etc. The setting section 50 may further set the amplification factors of the amplifying sections 22L, 22R, and, in the case where an equalizer is disposed in the sound emitting section 20, set the frequency characteristics of the equalizer.

The setting section 50 may set the combination ratios (the addition ratios or the like) of the audio signals in the combining sections 15L, 15R, 122L, 122R. When the combination ratio is set to a value other than the set ratios, an amplifying section or the like may be disposed in the signal path for the corresponding audio signal, and the audio signal on the signal path may be amplified by an amplification factor corresponding to the combination ratio.

In the speaker apparatus 1 according to the embodiment of the present disclosure, as described above, the audio signals in which signal processing for imparting the acoustic image of stereo effect and the sound image widening effect is performed on the monaural audio signal (the instrument sound) supplied through the monaural input terminal 3 and the other audio signals on which signal processing for imparting the sound image widening effect is not performed are supplied to the speaker units 2L, 2R, thereby causing a sound to be emitted. In the speaker apparatus 1, moreover, the audio signals in which signal processing for imparting the sound image widening effect is performed on the stereo audio signals (the sound of the music piece) supplied through the stereo input terminal 4 are supplied to the speaker units 2L, 2R, thereby causing a sound to be emitted.

When the guitar 70 and the audio player 80 are connected to the thus configured speaker apparatus 1 through the cables 91, 92, and sounds are emitted, the listener 1000 senses as if the sounds are emitted from the virtual speakers 2LS, 2RS (see FIG. 2) because the sound image widening effect is imparted on the sound of the music piece which is reproduced by the audio player 80, and the instrument sound of the guitar 70 to which the stereo effect is applied, and can feel widening of the sound field as compared with case where the sound image widening effect is not imparted.

By contrast, with respect to the instrument sound, also the sound to which the sound image widening effect is not imparted is emitted from the speaker units 2L, 2R, and hence the localization sensation of the sound image is hardly lost. Therefore, the listener 1000 can clearly listen to the instrument sound. At this time, in the case where the audio signals L2, R2 are identical to each other, the listener 1000 senses that the image of the instrument sound is localized in the direction of one point between the speaker units 2L, 2R (in the case where the combination ratios of the audio signals L2, R2 are equal to each other, the midpoint C (see FIG. 2)), and therefore can more clearly listen to the sound.

With respect to the sound of the music piece, only the sound to which the sound image widening effect is imparted is emitted. Therefore, the listener 1000 can clearly listen to the instrument sound without being disturbed by the sound of the music piece.

Modifications

Although the embodiment of the present disclosure has been described, the present disclosure can be implemented in various manners as described below. Moreover, the present disclosure may be implemented by adequately combining the configurations of the embodiment and the modifications.

First Modification

In the above-described embodiment, the widening effect imparting section 12 combines the audio signals L1, R1 indicating the sound of the music piece with the audio signals L3, R3 indicating the instrument sound, for each channel, and then the widening processing section 121 imparts the sound image widening effect to the combined signals. Alternatively, a configuration may be employed where different sound image widening effects are imparted to the audio signals L1, R1, L3, R3, respectively.

Figure 6:
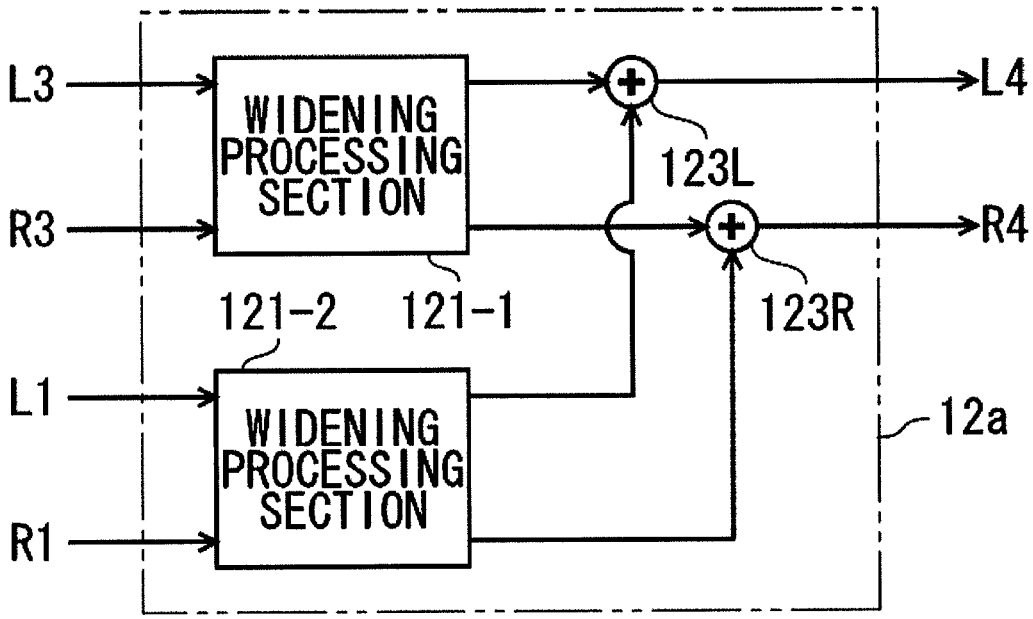
FIG. 6 is a block diagram illustrating the configuration of a widening effect imparting section in a first modification of the present disclosure.

FIG. 6 is a block diagram illustrating the configuration of a widening effect imparting section 12*a* in the first modification of the present disclosure. The widening effect imparting section 12*a* has widening processing sections 121-1, 121-2, and combining sections 123L, 123R. The widening processing sections 121-1, 121-2 are similar to the widening processing section 121 in the embodiment, and different only in that audio signals which are objects of the signal processing for imparting the sound image widening effect are different from each other. Namely, the widening processing section 121-1 performs signal processing for imparting the sound image widening effect to the audio signals L3, R3, and then outputs the signals, and the widening processing section 121-2 performs signal processing for imparting the sound image widening effect to the audio signals L1, R1, and then outputs the signals.

The combining sections 123L, 123R combine the audio signals which are output from the widening processing sections 121-1, 121-2, with each other for each channel by addition, and output the combined signals as the audio signals L4, R4, respectively.

In the widening effect imparting section 12*a*, as described above, different sound image widening effects can be imparted to the instrument sound and the sound of the music piece, and therefore the sound image localization range of the instrument sound can be differentiated from that of the sound of the music piece. The degree of the difference may be set in the setting section 50 by the listener by means of operating the operating section 5.

Second Modification

In the above-described embodiment, irrespective of a sound of a music piece and impartation/non-impartation of the sound image widening effect, the speaker apparatus 1 electrically combines audio signals with each other for each channel, and emits the L-channel audio signal from the speaker unit 2L, and the R-channel audio signal from the speaker unit 2R. Alternatively, audio signals may be combined with each other in a different manner. For example, the speaker apparatus may have a larger number of speakers, and sounds are combined with each other in the emission space. A speaker apparatus 1*b* in this case will be described.

Figure 7:
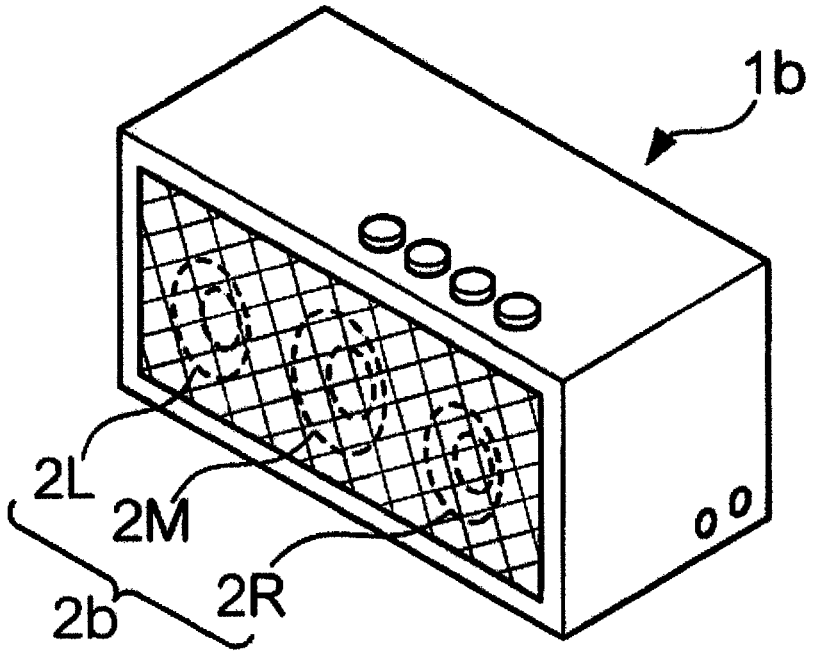
FIG. 7 is a view illustrating the appearance of a speaker apparatus of a second modification of the present disclosure.

FIG. 7 is a view illustrating the appearance of the speaker apparatus 1*b* of the second modification of the present disclosure. In the speaker apparatus 1*b*, a speaker section 2*b* is different from the speaker section 2 in the embodiment. The speaker section 2*b* further has a speaker unit 2M which is located between the speaker units 2L, 2R. As shown in FIG. 7, the speaker unit 2M may be larger in diameter of the cone paper than the speaker units 2L, 2R, or equal to or smaller than the speaker units.

Figure 8:
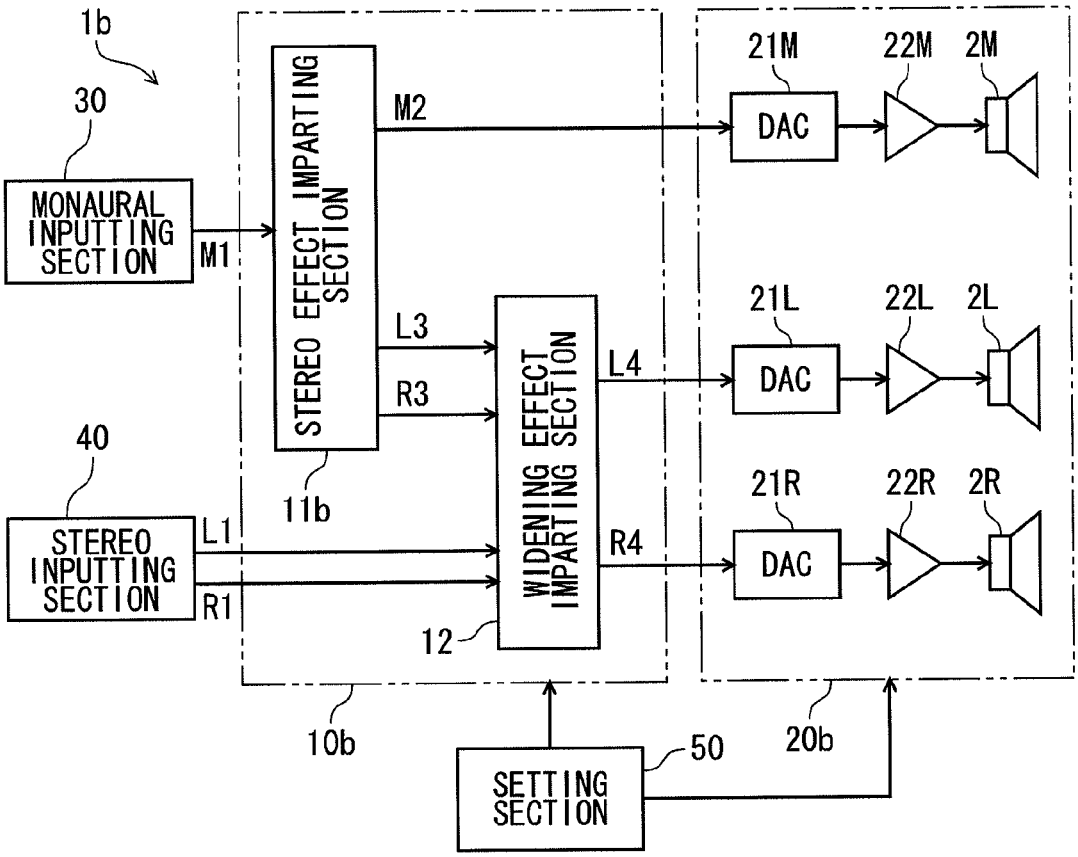
FIG. 8 is a block diagram illustrating the configuration of the speaker apparatus of the second modification of the present disclosure.

FIG. 8 is a block diagram illustrating the configuration of the speaker apparatus 1*b* of the second modification of the present disclosure. In the speaker apparatus 1*b*, a signal processing section 10*b* and a sound emitting section 20*b* are configured in a different manner from those of the embodiment, and the configuration corresponding to the combining sections 15L, 15R does not exist. In the following description, only the configuration of the speaker apparatus 1*b* which is different from that of the embodiment will be described.

A stereo effect imparting section 11*b* outputs an audio signal M2 in place of the audio signals L2, R2 which are output from the stereo effect imparting section 11.

Figure 9:
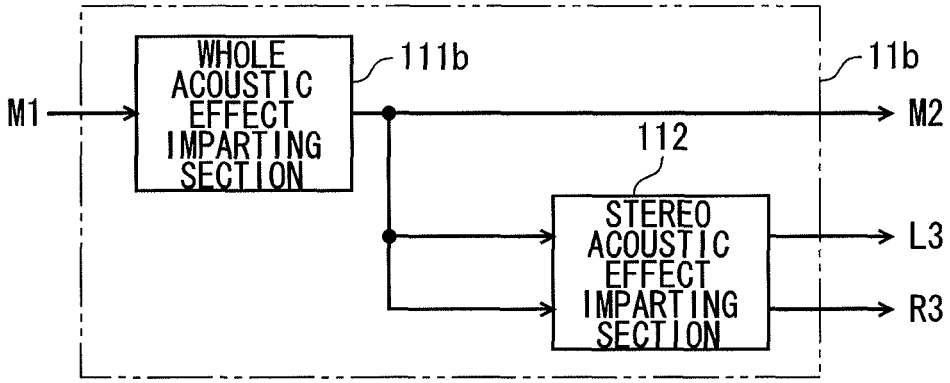
FIG. 9 is a block diagram illustrating the configuration of a stereo effect imparting section in the second modification of the present disclosure.

FIG. 9 is a block diagram illustrating the configuration of the stereo effect imparting section 11*b* in the second modification of the present disclosure. A whole acoustic effect imparting section 111*b* does not have a configuration where the monaural audio signal is divided into the audio signals L2, R2 as in the whole acoustic effect imparting section 111 in the embodiment, but outputs an audio signal M2 which remains to be monaural. Therefore, the audio signals L2, R2, which are supplied to the stereo acoustic effect imparting section 112 in the embodiment, are supplied as the audio signal M2 in the configuration of the second modification.

Returning to FIG. 8, the description will be continued. The sound emitting section 20*b* has a DA converting section 21M, an amplifying section 22M, and a speaker unit 2M in addition to the components of the sound emitting section 20 in the embodiment. These additional components are identical with those on the paths for the other audio signals except that the additional components are on the path for the audio signal M2 to be supplied to the speaker unit 2M, and therefore their description is omitted.

In the speaker apparatus 1*b* of the second modification, as described above, the sound which is the instrument sound and to which the sound image widening effect is not imparted is emitted from the speaker unit 2M instead of the speaker units 2L, 2R. In the speaker apparatus 1*b*, therefore, the sound emitted from the speaker unit 2M and the sounds emitted from the speaker units 2L, 2R are combined with each other in the space, and then reach the listener. According to the configuration, it is possible to achieve effects similar to those in the embodiment.

A larger number of speaker units may be disposed in the case 9, and, for example, the widening effect imparting section 12*a* in the first modification may be configured so that the audio signals output from the widening processing sections 121-1, 121-2 are not combined in the combining sections 123L, 123R, but output to the signal paths for respective other speaker units. In this case, the sounds may be combined with each other in the emission space.

Similarly with the embodiment, alternatively, the audio signal M2 may be supplied not only to the speaker unit 2M, but also to the speaker units 2L, 2R as the audio signals L2, R2.

Third Modification

In the above-described embodiment, the L-channel audio signal is supplied to the speaker unit 2L, and the R-channel audio signal is supplied to the speaker unit 2R. Alternatively, a tweeter, a subwoofer, and the like may be disposed, the audio signals may be split into frequency bands, and frequency band components may be supplied to the tweeter, the subwoofer, and the like. The subwoofer is not required to be disposed separately for each of the L channel and the R channel. Therefore, the L-channel audio signal and the R-channel audio signal may be combined with each other, and then supplied to the subwoofer.

In the case where, as shown in the second modification, another speaker unit such as the speaker unit 2M is disposed separately from the speaker units 2L, 2R, only a part of audio signals may be split into frequency bands, and frequency band components may be allocated to the speaker units. A speaker apparatus 1*c* in this case will be described with reference to FIG. 10.

Figure 10:
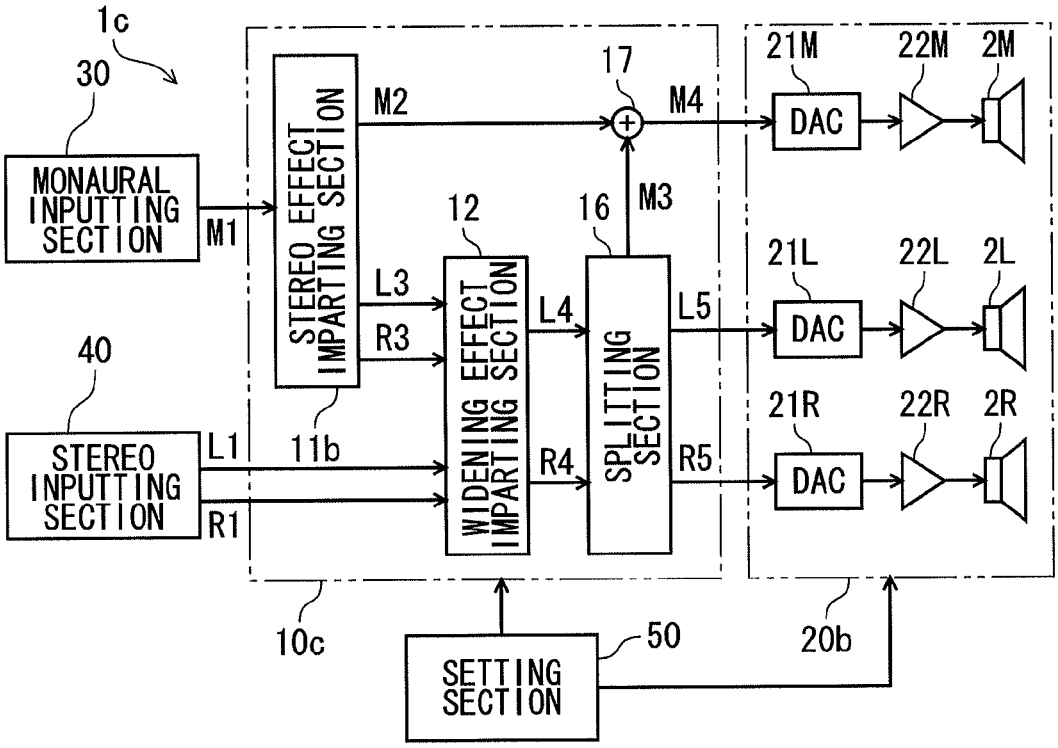
FIG. 10 is a block diagram illustrating the configuration of a speaker apparatus of a third modification of the present disclosure.

FIG. 10 is a block diagram illustrating the configuration of the speaker apparatus 1*c* of the third modification of the present disclosure. The speaker apparatus 1*c* has a signal processing section 10*c* including a splitting section 16 and a combining section 17, in addition to the components of the speaker apparatus 1*b* of the second modification. The other configuration is identical with the speaker apparatus 1*b*, and therefore its description is omitted.

The splitting section 16 splits the audio signals L4, R4 into and outputs an audio signal M3 and audio signals L5, R5 depending on frequency bands. The audio signal M3 has as a component of a low-frequency band which is obtained by adding the audio signals L4, R4 that have been passed through a low-pass filter having a predetermined cutoff frequency fc. The audio signals L5, R5 correspond to the audio signals L4, R4 that have been passed through a high-pass filter having a cutoff frequency fc, and have a high-frequency band as a component. Alternatively, the high-pass filter may not be used, and the audio signals L5, R5 may be set to be identical with the audio signals L4, R4. The setting section 50 may be configured so as to set the frequency bands of the audio signals which are to be split in the splitting section 16.

The combining section 17 adds the audio signals M2, M3 to each other to combine them together, and outputs the combined signal as an audio signal M4 to the signal path through which an audio signal is to be supplied to the speaker unit 2M.

In this way, the audio signals to be supplied to the speaker units may be configured by any one of various combinations depending on the frequency band component.

For example, the process in the splitting section 16 may be performed on the audio signals to be supplied to the widening effect imparting section 12. In this case, an audio signal in which low-frequency band components of all the audio signals L1, R1, L3, and R3 are combined with each other is used as the audio signal M3. The audio signals supplied to the widening effect imparting section 12 are high-frequency band components of the audio signals L1, R1, L3, R3. Alternatively, this process may be performed only on the audio signals L1, R1 instead that the process is performed on the audio signals L1, R1, L3, and R3.

In this example, the audio signals which are split in accordance with the frequency band are those which have undergone the signal processing in the widening effect imparting section 12. Alternatively, the audio signal M2 which has not undergone the signal processing in the widening effect imparting section 12 may be split in accordance with the frequency band, and a high-frequency part may be emitted from the speaker units 2L, 2R.

Fourth Modification

In the above-described embodiments, the audio signals which are supplied to the stereo input terminal 4 are stereo or two-channel signals. Alternatively, signals of a larger number of channels may be supplied. In the alternative, the signals are downmixed to two-channel signals in the stereo inputting section 40, or only a part of the signals is used so as to be handled as two-channel signals.

Fifth Modification

In the above-described embodiment, the speaker apparatus 1 has been described by illustrating a musical instrument amplifier. Alternatively, the speaker apparatus may be an apparatus which is integrated with a musical instrument such as the guitar 70, that which is integrated with the audio player 80, or that in which the whole is integrated. In the case of an integrated apparatus, the cables are not necessary, and the input terminals may be omitted.

Sixth Modification

In the above-described embodiment, one of the audio signals L2, R2 may not be output from the stereo effect imparting section 11. In this case, the instrument sound to which the sound image widening effect is not imparted is output from only one of the speaker units 2L, 2R. In this way, the instrument sound to which the sound image widening effect is not imparted is requested to be output from one of the speaker units.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2011-189285 filed on Aug. 31, 2011, the contents of which are incorporated herein by reference.

What is claimed is:

1. A speaker apparatus comprising:

a sound emitting section that includes a plurality of speaker units, each of which converting a supplied audio signal to a sound and outputting the sound, and the speaker units including a speaker unit for an L channel and a speaker unit for an R channel;

a first inputting section to which one channel audio signal indicating a sound from a sounding body is supplied;

an acoustic effect imparting section that performs a first signal processing for imparting an acoustic image of stereo effect, on the audio signal supplied to the first inputting section to output L channel and R channel audio signals;

an outputting section that outputs the audio signal supplied to the first inputting section, to at least one of the speaker units; and a widening effect imparting section that performs a second signal processing for imparting a sound image widening effect which widens a range where a sound image is localizable, to be larger than a gap between the speaker unit for the L channel and the speaker unit for the R channel, on the L-channel and R-channel audio signals output from the acoustic effect imparting section, to supply processed audio signals to speaker units for corresponding channels respectively, among the speaker units, wherein the outputting section splits the audio signal supplied to the first inputting section into two audio signals to output the two audio signals to the at least one of the speaker units, and wherein when the two audio signals are identical to each other, an image of a sound of the audio signal supplied to the first inputting section is localized in a direction between the speaker units.

2. The speaker apparatus according to claim 1, wherein the outputting section performs a third signal processing which is different from the first signal processing in the acoustic effect imparting section, on the audio signal supplied to the first inputting section, to output a processed audio signal to the at least one of the speaker units.

3. The speaker apparatus according to claim 1, wherein the audio signal output from the outputting section is supplied to the at least one of the speaker units to which the widening effect imparting section supplies the processed audio signals.

4. The speaker apparatus according to claim 1, wherein the speaker units of the sound emitting section include a middle speaker unit which is disposed between the speaker unit for the L channel and the speaker unit for the R channel; and wherein the audio signal output from the outputting section is supplied to the middle speaker unit.

5. The speaker apparatus according to claim 1, wherein the widening effect imparting section combines the L-channel and R-channel audio signals output from the acoustic effect imparting section with the at least L-channel and R-channel audio signals supplied to the second inputting section for each channel, and performs the second signal processing for imparting the sound image widening effect on the combined audio signals.

6. The speaker apparatus according to claim 1, wherein the widening effect imparting section performs different signal processings on the L-channel and R-channel audio signals output from the acoustic effect imparting section and the at least L-channel and R-channel audio signals supplied to the second inputting section, respectively, so as to set different ranges where the sound images are localizable.

7. The speaker apparatus according to claim 1, further comprising:

a second inputting section to which at least L-channel and R-channel audio signals are supplied, wherein the widening effect imparting section performs the second signal processing on both the L-channel and R-channel audio signals output from the acoustic effect imparting section and the at least L-channel and R-channel audio signals supplied to the second inputting section, to supply the processed audio signals to the speaker units for corresponding channels respectively, among the speaker units.

* * * * *